United States Patent [19]

Dempsey et al.

[11] Patent Number: 4,815,524

[45] Date of Patent: Mar. 28, 1989

[54] CONTROL SYSTEM FOR A FURNACE OPERATING IN THE CONTINUOUS BLOWER MODE

[75] Inventors: Daniel J. Dempsey, Carmel; Gary W. Ballard, Indianapolis, both of Ind.

[73] Assignee: Carrier Corporation, Syracuse, N.Y.

[21] Appl. No.: 67,501

[22] Filed: Jun. 29, 1987

[51] Int. Cl.[4] ..... F28F 27/00; F23N 5/20; F25B 29/00

[52] U.S. Cl. ..... 165/12; 165/14; 165/24; 165/921; 236/11; 236/46 E

[58] Field of Search ..... 236/11, 46 E; 165/12, 165/14, 24, 25, 913, 921

[56] References Cited

U.S. PATENT DOCUMENTS

| | | | |
|---|---|---|---|
| 1,969,113 | 8/1934 | Baker | 236/11 |
| 2,110,693 | 3/1938 | Bailey | 236/46 |
| 2,221,041 | 11/1940 | Baker | 236/11 |
| 2,224,946 | 12/1940 | Appel | 236/11 |
| 2,230,446 | 2/1941 | Baker | 236/11 |
| 2,495,861 | 1/1950 | Newton | 236/46 E |
| 2,955,435 | 10/1960 | Willette | 165/25 |
| 4,136,730 | 1/1979 | Kinsey | 165/12 |
| 4,167,966 | 9/1979 | Freeman | 165/2 |
| 4,189,091 | 2/1980 | Ballard et al. | 236/11 |
| 4,502,625 | 3/1985 | Mueller | 236/46 E |
| 4,667,874 | 5/1987 | Johnson et al. | 236/46 E |

*Primary Examiner*—Samuel Scott
*Assistant Examiner*—John K. Ford
*Attorney, Agent, or Firm*—Dana F. Bigelow

[57] ABSTRACT

A furnace having the capability of operating its blower continuously is provided with means for automatically shutting off the blower at the beginning of a heating cycle and for resuming the operation thereof only after a predetermined time has elapsed to allow the heat exchanger to heat up to a temperature that exceeds the dew point of the flue gas, to thereby reduce the occurrence of cold spot corrosion in the heat exchanger. Provision is also made, in a two speed blower system, for operating at a lower speed during continuous mode and heating cycle operation, and for operating at the higher speed during the cooling cycles.

9 Claims, 4 Drawing Sheets

CONTROL SYSTEM FOR A FURNACE OPERATING IN THE CONTINUOUS BLOWER MODE

BACKGROUND OF THE INVENTION

This invention relates generally to residential furnaces and, more particularly, to a speed control system for a furnace air delivery blower operating continuously.

The most common type of furnace used in residential applications is the forced air furnace, with a fan or blower which operates to draw in the return air from the space to be heated, pass it over the heat exchanger(s) to heat up the air, and deliver it to the duct for distribution within the spaces to be heated. Such a forced air system has been found to be easily adapted for use in combination with an air conditioning or heat pump system. This is commonly accomplished by way of installing the indoor coil of an otherwise conventional split system apparatus, in the air flow distribution path such that the furnace blower can be used as the blower mechanism with the evaporator coil. For example, in an upflow furnace, the indoor coil for the air conditioner/heat pump is commonly located at the top of the furnace, just above the furnace heat exchanger, so that the air being delivered to the residential spaces flows in heat exchange relationship therewith just prior to its entering into the distribution system.

One of the problems that may occur in the operation of a forced air furnace is that of condensate dwell which is caused by excessive condensate dwell time, i.e. condensation of flue gases within the heat exchanger during the beginning of a heating cycle when the heat exchangers are cold. It has been recognized that the condensate dwell time can be reduced by delaying the turning on of the air delivery blower at the beginning of the heating cycle, until the heat exchanger has had sufficient time to heat up from the flue gases flowing therethrough. Such a delay approach has been satisfactory in reducing excessive condensate dwell time in systems where the air delivery blower was selectively turned on for either the cooling or heating modes. But it no longer applicable when a system is operating in a continuous blower mode, which has now become quite common.

The normal approach to a continuous blower mode of operation is to allow the blower to run constantly, regardless of whether the furnace or the air conditioner/heat pump is on, to thereby continuously clean and move the air. If the blower motor is of the variable speed type, which permits a higher speed of operation for cooling and a lower speed for heating, the continuous mode of operation has traditionally called for high speed operation to ensure that the system is in fact operating at sufficient speed during the cooling process. Such a higher speed operation has been satisfactory for the heating mode, but with the recognition that the energy usage for the heating mode is somewhat higher than it would be if not operating in the continuous blower mode. The problem that arises with such a continuous blower operation is therefore that of excessive condensate dwell leading to cold spot corrosion as mentioned hereinabove. When the burner is turned on at the start of a heating cycle, not only is the air delivery blower on, but it is operating at the higher speed. The flue gases will therefore tend to condense during the time period in which the heat exchanger is warming up.

That condensate will then cause corrosion of the heat exchanger.

It is therefore an object of the present invention to provide an improved control system for a blower of a forced air furnace.

Another object of the present invention is the provision in a forced air furnace for operating the blower on a continuous basis without incurring excessive condensate dwell in the heat exchanger.

Yet another object of the present invention is the provision in a forced air furnace for reducing the formation of condensation in the heat exchanger during the initial stages of a heating cycle while operating in a continuous blower mode.

Yet another object of the present invention is the provision for continuously operating the blower of a forced air furnace in an economical manner.

Still another object of the present invention is the provision in a forced air furnace for a continuous blower control which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, the control system of a forced air furnace is provided with means for sensing when the blower is in a continuous mode of operation and if sensed at the startup of a heating cycle, the blower is automatically turned off. The control then causes the blower motor to wait for a predetermined period of time to allow the heat exchanger to heat up after ignition, and then the blower is automatically turned on. In this way, the heat exchanger is well heated before the circulating air is passed thereover, to thereby reduce the amount of condensation therein which would tend to cause cold spot corrosion.

In accordance with another aspect of the invention, provision is made in the control system of a furnace having a continuous blower capability, to distinguish between heating and cooling modes of operation and to select the appropriate blower speed accordingly. The control automatically causes the blower motor to operate at a higher speed during the cooling mode operation and at a lower speed during a heating mode operation. Further, it causes the blower to run only at the lower speed for continuous mode operation. Thus, when the blower is turned back on after a predetermined period following shutdown at the beginning of a heating cycle, its speed is maintained at a predetermined slower speed during the remainder of the heating cycle. When a heating cycle is completed, the control system will automatically change back to the continuous blower mode with the blower operating at the lower speed. This will allow the blower to provide for a continuous flow of air but in a more economical manner than when the blower is continuously operated at its higher speed, as is conventionally done. If, subsequently, the sensed conditions should indicate a need for cooling operation, then the cooling mode will be initiated and, at that time, the control system will cause the blower motor to accelerate to the higher speed and to remain at that speed during the remainder of the cooling cycle, after which time the speed will be automatically reduced to the lower speed for continuous mode operation.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
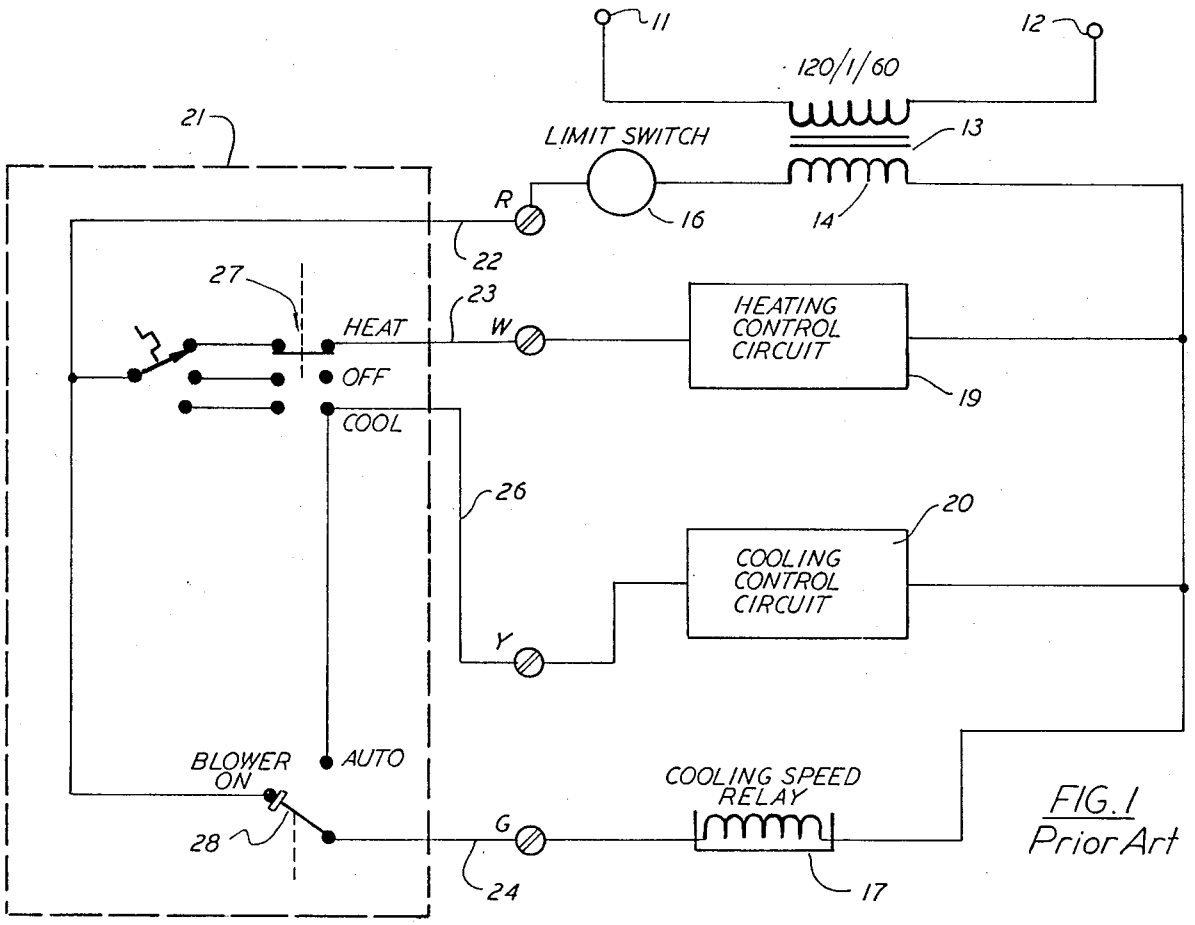
FIG. 1 Prior Art
FIG. 1 is a schematic illustration of a conventional control for a blower system with provision for continuous operation.

Referring now to FIG. 1, there is shown a portion of a furnace control system for controlling the blower fan speed in a conventional manner. This circuit receives a low voltage supply from high voltage terminals 11 and 12 by way of a low voltage stepdown transformer 13. The transformer secondary coil 14 is in series with a limit switch 16 and a cooling speed relay 17, between terminals R and G. Connected in parallel to that circuit is a heating control circuit 19 leading to terminal W and a cooling control circuit 20 leading to terminal Y. A thermostat 21, indicated by the broken lines, is connected to the R, W and G terminals of that circuit by way of leads 22, 23 and 24, respectively. A fourth lead 26 interconnects the thermostat 21 to the Y terminal of the control circuit. A switch 27 is interconnected between lead 22 and the leads 23 and 26, respectively, such that the operator can select between the heating, cooling, or off-mode conditions. When the heating mode is selected, the switch 27 closes circuit RW as shown, and when the cooling circuit is selected the RY circuit is closed. Also contained within the thermostat 21 is a switch 28 which allows the operator to select between the "automatic" and "on" modes of operation for the blower, with the "on" position switch acting to provide for continuous operation of the blower. When the switch 28 is in the "automatic" position, the YG circuit is closed, and when it is in the "on" or continuous position, the RG circuit is closed.

Figure 2:
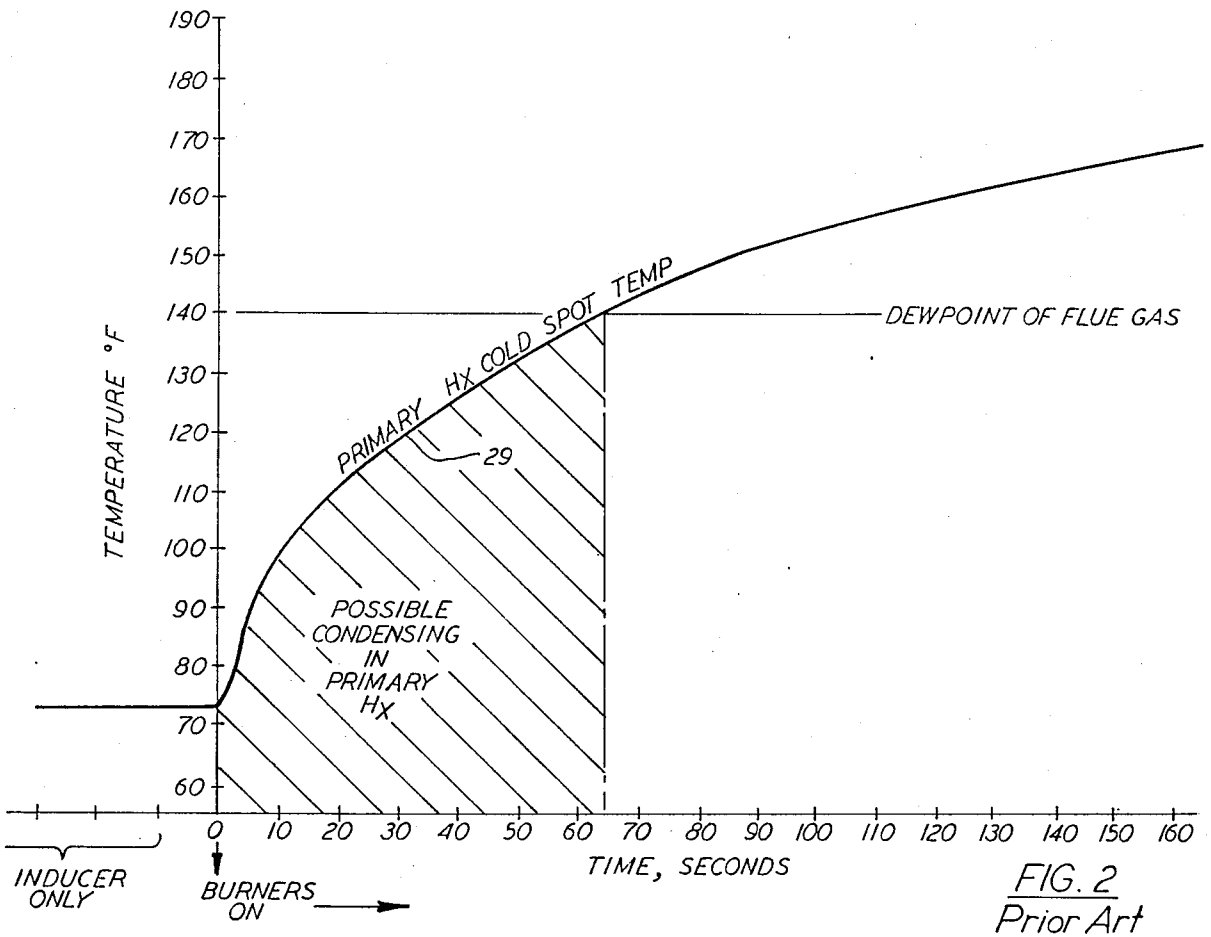
FIG. 2 Prior Art
FIG. 2 is a graphic illustration of the heat exchanger temperatures during the initial stages of the heating cycle of such a system.

In operation, when the thermostat calls for heat, the RW circuit is closed and the heating control circuit 19 is activated. If the switch 28 is in the "on" or continuous position as shown, the RG circuit is closed and the cooling speed relay coil 17 is energized to turn on the cooling speed of the blower. Thus, the blower will be operating at the cooling (high) speed during the period in which the furnace heat exchanger is heating up in the initial stages of the heating cycle. The effect of this is illustrated in FIG. 2 wherein the initial stages of a typical heating cycle performance parameters are shown.

Assuming that the blower motor is on at the time that the burners come on, and further that the heat exchanger is at ambient temperature conditions (e.g. 73° F.), the temperature of the flue gases begins to rise gradually as shown by the curve 29. After a minute or so, the time being dependent on the particular heat exchanger design, the firing rate and the airflow rate, the temperature of the coolest part of the heat exchanger has reached the flue gas dew point (approx. 130° F.) and thus it will no longer condense the flue gases flowing therethrough. However, during that initial minute, when the temperature of the heat exchanger is below the flue gas dew point, the flue gases will condense at the coolest parts of the heat exchanger, with the condensate tending to cause cold spot corrosion. That area under the curve 29 is thus indicative of the amount of such condensation that may occur in the start of a heating cycle when the blower is on.

Figure 3:
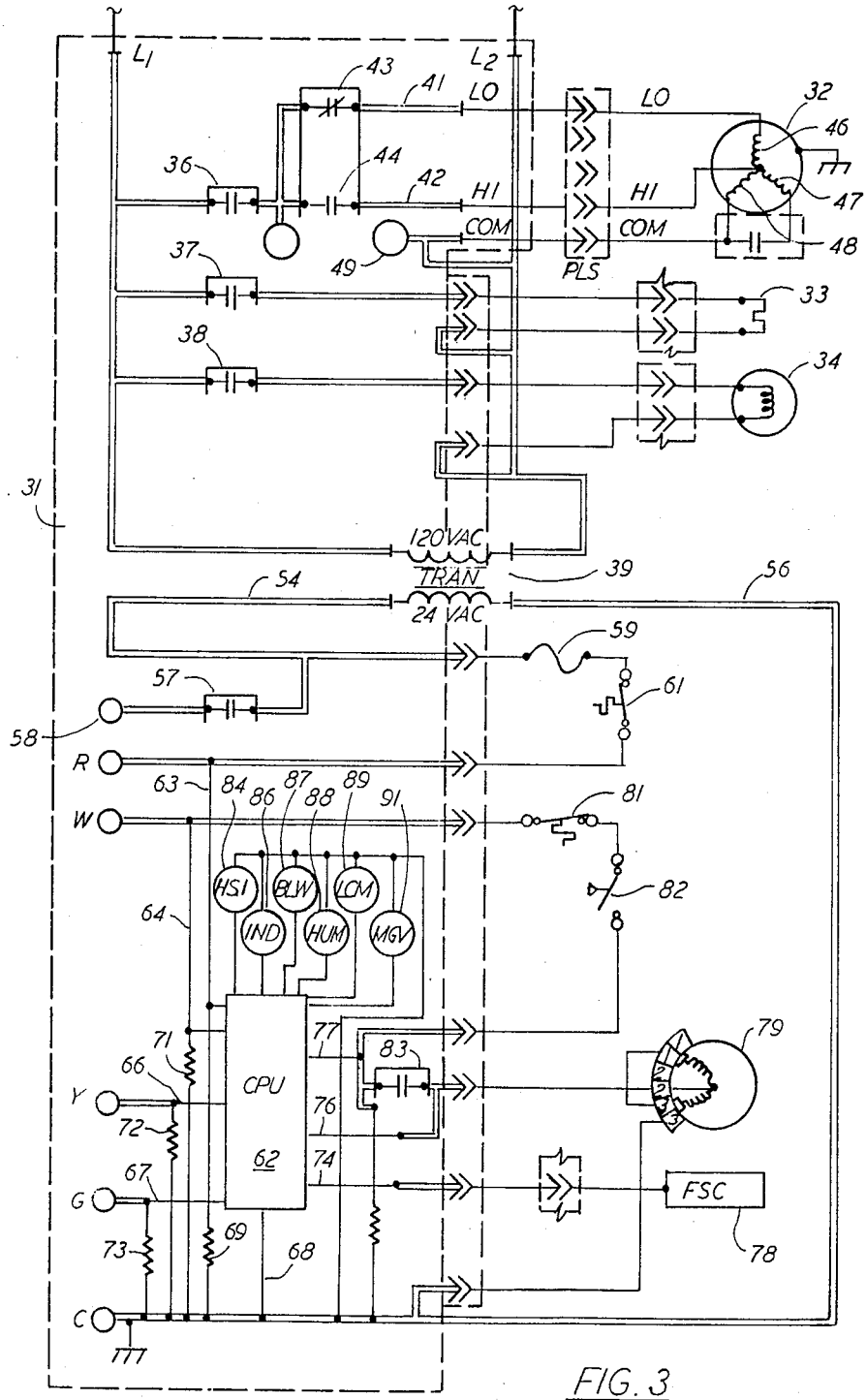
FIG. 3 is a schematic illustration of the control system of the present invention.

Referring now to FIG. 3, the control circuitry of a forced air furnace is shown to include the features of the present invention. A circuit board 31, as indicated by the broken lines, is provided line voltage by way of leads L1 and L2. Power is thus provided to a circulating air blower motor 32, a hot surface igniter 33, and an inducer motor 34 by way of relays 36, 37 and 38, respectively. Power is also provided to the control portion of the circuit board by way of a low voltage stepdown transformer 39.

In addition to the relay 36 which is in the circuit supplying power to the blower motor 32, parallel leads 41 and 42 are provided for low and high speed connections, respectively, and a single pole double throw relay is provided with the low speed lead 41 having normally closed relay contacts 43 and the high speed lead 42 having normally open relay contacts 44. Both the low speed lead 41 and the high speed lead 42 are connected to one leg 46 of the Wye connected blower motor 32, with the other legs 47 and 48 being connected to a common terminal 49. Thus, by controlling the relay contacts 43 and 44, the blower motor 32 can be selectively caused to operate at either the low or high speeds.

Referring now to the control or bottom portion of the circuit, low voltage power is provided from the secondary coil of the transformer 39 to the conductor 54 and to the conductor 56, which is connected to the common terminal C. The conductor 54 is electrically connected through normally open relay contacts 57 to a terminal 58 which provides power to the humidifier (not shown), and also to a circuit which includes a fusible link 59 sensitive to overtemperature, a resettable limit switch 61 sensitive to overtemperature, and the terminal R.

Similar to the conventional connections as discussed hereinabove, the R, W, Y, G, and C terminals of the circuit board 31 are connected to the room thermostat. However, unlike the conventional circuit, each of those terminals is connected to a microprocessor 62 by way of leads 63, 64, 66, 67, and 68, respectively. Load resistors 69, 71, 72 and 73 are provided between the common terminal C and the respective terminals R, W, Y and G to increase the current flow through the circuits to thereby prevent the occurrence of dry contacts.

Other inputs to the microprocessor 62 are provided along lines 74, 76 and 77. The line 74 is connected to a flame sensing circuit 78 which operates in response to a flame sensing electrode (not shown) to provide a signal to a microprocessor to indicate when a flame has been proven to exist.

The line 76 is connected to a main gas valve 79 and provides an indication to the microprocessor 62 whether the gas valve is on or off. Power to the main gas valve 79 is received from the terminal W by way of an auxiliary limit switch 81, a pressure switch 82 and the normally open relay contacts 83. The microprocessor 62 is made aware of the condition of the auxiliary limit switch 81 and the pressure switch 82 by way of signals received along line 77.

Having described the circuits that are controlled by the microprocessor 62 by way of relays, the controlling outputs of the microprocessor 62 will now be briefly described. The hot surface ignitor output 84 operates to close the relay contacts 37 to activate the hot surface igniter 33. The inducer motor output 86 operates to close the relay contacts 38 to activate the inducer motor 34. The blower motor output 87 operates to close the relay contacts 36 to activate the blower motor 32. The humidifier output 88 operates to close the relay contacts 57 to activate the humidifier. The low/high relay 89 output operates to open the relay contacts 43 and close the relay contacts 44 to switch the blower motor 32 from low to high speed operation. Finally, the main gas valve output 91 operates to close the relay contacts 83 to activate the main gas valve 79.

Considering now the operation of the control apparatus during a typical heating cycle, the sequence of operation will be as follows. When the wall thermostat calls for heat, the R and W circuits are closed. The microprocessor 62 checks the inputs and outputs and energizes the inducer relay 38 to start the inducer motor 34. As the inducer motor 34 comes up to speed, the pressure switch 82 closes to commence the purge process. After a predetermined period of time, the microprocessor 62 activates the hot surface ignitor relay 37 to provide power to the hot surface ignitor 33. After a warmup period of a predetermined time, the microprocessor 62 activates the main gas valve relay 83 to turn on the main gas valve 79. As soon as a flame is sensed by the flame sensing circuit 78, the microprocessor 62 deactivates the hot surface ignitor 37, and the flame proving circuit holds the main gas valve on so long as the flame is present or until the thermostat is satified.

During continuous blower operation when a call for neat is initiated, and the R-W circuit is closed, the microprocessor turns off the blower 32 by opening the relay contacts 36, and then after a predetermined time, the microprocessor 62 again activates the blower relay 36 to turn on the blower motor 32 at a low speed. Typically, the microprocessor will be set to hold the blower motor 32 off for a period of 40 to 75 seconds after the flame is proven.

When the thermostat is satisfied, the R and W circuits are de-energized to thereby de-energize the main gas valve 79, and, after a post-purge period, the inducer motor 74. The blower motor 32 will continue to operate at the lower speed so long as the thermostat continues to call for a continuous blower operation by way of signals from terminal G to the microprocessor 62.

If the thermostat subsequently calls for cooling, while the blower relay 36 is activated by way. of thermostat signals to terminal G, the microprocessor 62 will be prompted to activate the single pole double throw relay to open the contacts 43 and close the contacts 44 to thereby switch the blower motor 32 to the higher speed. When the thermostat is satisfied the thermostat signal to the Y terminal is removed to thereby de-activate the single pole double throw relay so as to thereby open the contacts 44 and close the normally closed contacts 43 such that the blower motor 32 again resumes the lower speed operation.

Figure 4:
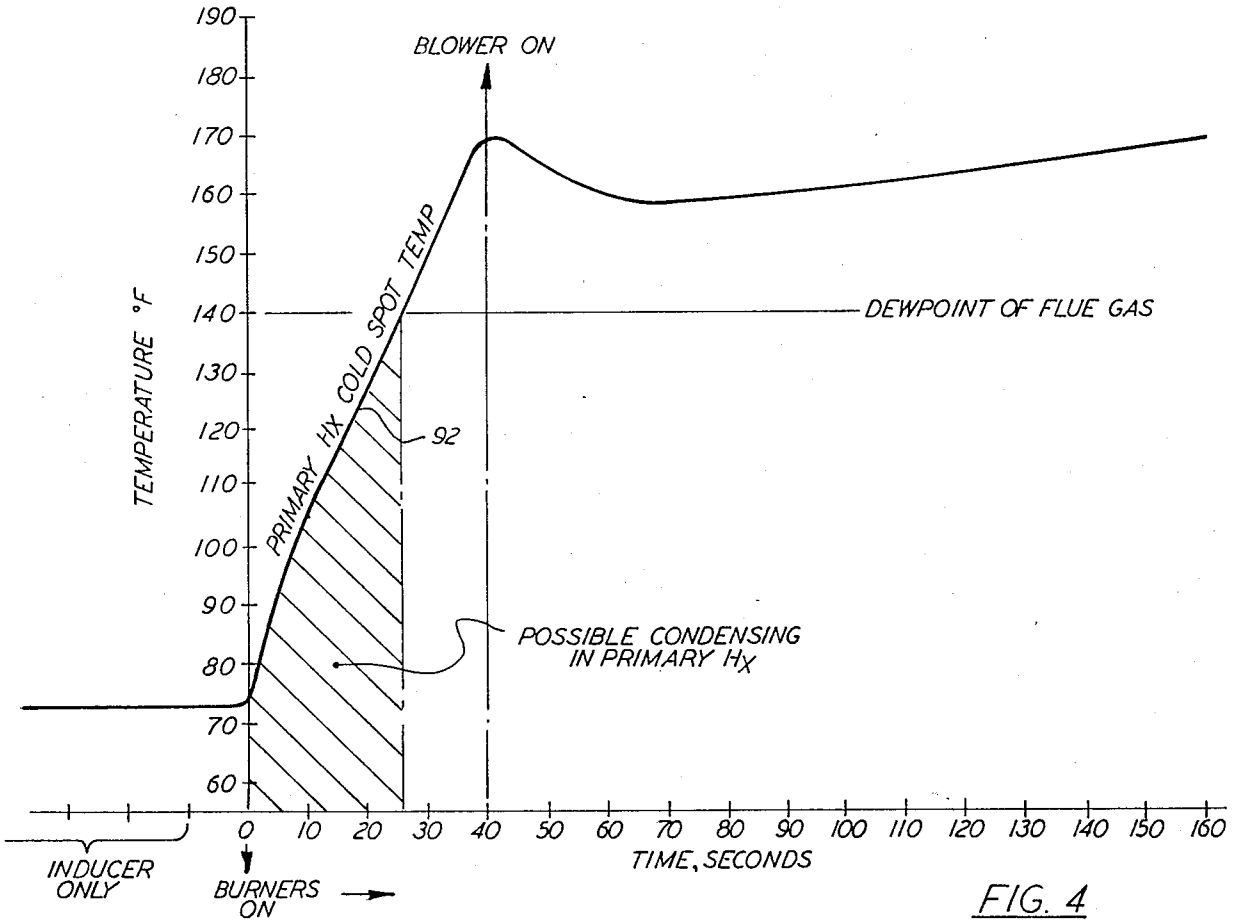
FIG. 4 is a graphic illustration of the heat exchanger temperatures during initial stages of a heating cycle thereof.

Referring now to FIG. 4, the effect of the above-described control system as it relates to the reduction in condensation at the heat exchanger can be seen. Again, assuming that the inducer motor is on when the burners come on and that the heat exchanger is at ambient temperature conditions (e.g. 73° F.), if the blower is now turned off at the beginning of the cycle, the temperature of the flue gases is seen to rise rapidly during the entire period of 40–75 seconds in which the blower is held off. But the temperature of the heat exchanger reaches that of the dew point of the flue gas after about 25 seconds. Thus, it will be seen that the cross-hatched area under the curve 92, is indicative of the amount of condensation that may occur in the heat exchanger, is substantially less than that shown for the conventional system in FIG. 2. The tendency for cold spot corrosion occurring in the heat exchanger is accordingly reduced.

It will be seen that when the blower is turned on after 40–75 seconds, the heat exchanger temperature will be reduced fairly quickly to a point and will then begin to gradually rise, but it will not be reduced to the point where condensation will again occur. While the time period of delay may be varied from the 40 seconds as shown, it should thus be understood that it should preferably go beyond the point where the flue gas dew point is reached because of this tendency for the blower to reduce the temperature of the heat exchanger.

While the present invention has been described with particular reference to a preferred embodiment, the concepts of the invention are readily adaptable to other embodiments, and those skilled in the art may vary the structure thereof without departing from the essential spirit of the present invention. For example, although the system has been described in terms of an induced draft furnace, the present invention is equally applicable to a natural draft furnace.

What is claimed is:

1. A control system for a conditioned air delivery apparatus comprising:

an air delivery blower that is capable of selectively operating on a substantially continuous basis to provide a flow of air to a building space;

cooling means for selectively cooling the air which is provided to the building space;

heating means for selectively heating the air which is provided to the building space;

mode control apparatus having means for selectively turning on and off both said cooling and said heating means in response to pre-established conditions and sensed parameters; and speed control means for determining when said air delivery blower is operating on a continuous basis and for responsively turning off said air delivery blower when said heating means is turned on and for turning said air delivery blower back on after a predetermined period of time thereafter.

2. A control system as set forth in claim 1 wherein said heating means comprises a furnace with a heat exchanger which is susceptible to cold spot corrosion if condensation is formed therein.

3. A control system as set forth in claim 1 wherein said air delivery blower is capable of multi-speed operation and further wherein said speed control means is operative to select and control the operational speed thereof.

4. A control system as set forth in claim 3 wherein said speed control means operates to cause said air delivery blower to operate at a lower speed when said heating means is activated than when said cooling means is activated.

5. In a heating system of the type having provision for selectively operating the blower motor on a continuous basis, a control system comprising:

sensing means for determining when the blower is operating in the continuous mode; and heating control means responsive to said sensing means for turning off said blower when a heating cycle is initiated and for resuming operation of the blower only after a predetermined period following said initiation of a heating cycle.

6. A control system as set forth in claim 5 wherein said predetermined period is selected to correspond with but exceed, that period necessary for the flue gases in a heat exchanger to reach their dew point temperature.

7. A control system as set forth in claim 5 wherein said blower motor is capable of operating at two different speeds, and further, wherein when the blower motor operation is resumed, it is resumed at the lower of the two speeds.

8. A control system as set forth in claim 5 wherein said blower motor is capable of operating at two different speeds, and further wherein, when it is operating on a continuous basis, it operates at the lower speed.

9. A control system as set forth in claim 5 wherein said blower motor is capable of operating at two different speeds and further wherein said control system includes speed control means for causing the blower motor to operate at a lower speed during the heating cycle and at a higher speed during the cooling cycle.

* * * * *